US006102047A

United States Patent [19]

Manderick

[11] Patent Number: 6,102,047

[45] Date of Patent: Aug. 15, 2000

[54] COMBINATION CIGAR PUNCH, STAND AND HOLDER

[76] Inventor: Michael V. Manderick, P.O. Box 907, Somerset, Ohio 43783-0907

[21] Appl. No.: 08/814,897

[22] Filed: Mar. 12, 1997

[51] Int. Cl.[7] ..... A24F 13/22; A24F 13/24

[52] U.S. Cl. ..... 131/255; 131/257; 131/240.1; 131/239; 206/101; 206/96

[58] Field of Search ..... 131/248, 254, 131/329, 170, 253, 188, 233, 178, 185, 255, 257, 240.1, 239; 248/188.6, 188.7, 188.8; 401/131; 206/101, 102, 96

[56] References Cited

U.S. PATENT DOCUMENTS

| | | | |
|---|---|---|---|
| D. 246,803 | 12/1977 | Steinberg | D27/192 |
| 282,183 | 7/1883 | Fletcher | 131/256 |
| D. 314,639 | 2/1991 | Roussea | D27/195 |
| D. 375,576 | 11/1996 | Mesco | D27/195 |
| 3,107,674 | 10/1963 | Smith | 131/250 |
| 4,027,682 | 6/1976 | Halmaghi | 131/250 |
| 4,616,665 | 10/1986 | Cho | 131/351 |
| 4,660,575 | 4/1987 | Andreason et al. | 131/256 |
| 4,685,477 | 8/1987 | Valdez | 131/175 |
| 4,711,254 | 12/1986 | Fleisher et al. | 131/189 |
| 5,303,721 | 4/1994 | Bowen et al. | 131/248 |
| 5,310,145 | 5/1994 | Chen | 248/170 |
| 5,524,646 | 6/1996 | Reich | 131/329 |
| 5,535,763 | 7/1996 | Lonte | 131/255 |

*Primary Examiner*—John G. Weiss

[57] ABSTRACT

A cigar punch, stand and holder appliance comprised of a tube body 10 having a match stop 12 divider therein making a match holding compartment 28. A knurled cap 20 threaded to fasten securely to the top of the appliance with the top of the knurled cap having a match striking surface 26 and the bottom portion of the knurled cap having a bulls-eye cutter 22 for plugging cigars. A pocket clip with locking spring for cigar support 16 to receive a cigar support clip 18 to hold a cigar. A base mount 24 with support legs 14 extendable to erect a holding stand for cigar use.

1 Claim, 2 Drawing Sheets

COMBINATION CIGAR PUNCH, STAND AND HOLDER

BACKGROUND

1. Field of Invention

This instrument relates to a hand-held cigar punch, stand and holder combination; specifically one that holds a cigar in a stable position on a flat surface independently.

2. Description of Prior Art

Although there are many types of cigar punches, my invention is one of several conveniences for cigar smokers, rather than only being used as a cigar punch. Cigar holders, for the purpose of holding a cigar, include only plastic or wooden type mouthpieces which do not provide a means to set the cigar down as my invention does.

Prior arts indicate the absence of a cigar holding instrument which holds a cigar and being capable of performing other conveniences as my invention does.

Ashtrays are the closest form of prior art for setting cigars down onto for the purpose of holding cigars, and cigar and tobacco shops supply cigar smokers with only that one means of setting a cigar down. Ashtrays are normally not large enough for cigars to rest comfortably on and ashtrays are hard to balance a cigar on so that the cigar will not roll off of the resting area of the ashtray. Few ashtrays are made to accommodate cigars of various sizes and they are impractical to carry around for usage. My invention makes all table ashtrays usable for cigar smokers regardless of the size or shape of the ashtray.

OBJECTS AND ADVANTAGES

Accordingly, besides the objects and advantages of the cigar punch, stand and holder combination described in my above patent, several objects and advantages of the present invention are:

(a) to provide a safe method of holding a cigar securely so as to prevent fire hazards by not using ashtrays that are not intended for use by cigar smokers;

(b) to provide a stand that will hold a cigar as one smokes the cigar;

(c) to provide ease of setting down a cigar so as to use one's hands for other purposes while smoking a cigar;

(d) to provide a convenient cigar punch;

(e) to provide a way to keep one from chewing on their cigar because there is no place to safely set the cigar down;

(f) to provide a safe place to carry wooden matches;

(g) to provide a match striking surface; and (h) to provide a means to use all table ashtrays regardless of their size or shape.

Further objects and advantages are to provide an instrument which can easily be carried as a pen-like instrument by use of a pocket clip or by conveniently being placed into a pocket or purse. Still further objects and advantages will become apparent from a consideration of the ensuing description and drawings.

DRAWING FIGURES

In the drawings, closely related figures have the same number but different alphabetic suffixes.

FIG. 1B shows the pocket clip with locking spring for cigar support side of the instrument.

FIG. 1C shows the cigar support clip side of the instrument.

REFERENCE NUMERALS IN DRAWINGS

Figure 1A:
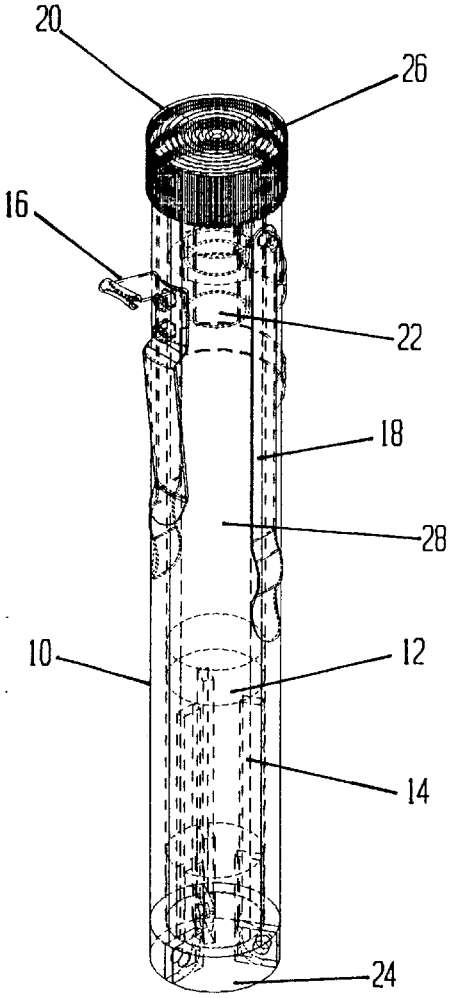
FIGS. 1A to 1C show various aspects of the instrument. Those shown in FIGS. 1A, 1B, 1C being a tube body, a match striking surface, a bulls-eye cutter, a pocket clip with locking spring for cigar support, a match stop, a match holding compartment, support legs, a base mount, a knurled cap, and a cigar support clip.

10 tube body
12 match stop
14 support legs
16 pocket clip with locking spring for cigar support
18 cigar support clip
20 knurled cap
22 bulls-eye cutter
24 base mount
26 match striking surface
28 match holding compartment

DESCRIPTION

FIGS. 1A, 1B, 1C, 2

Figure 1B:
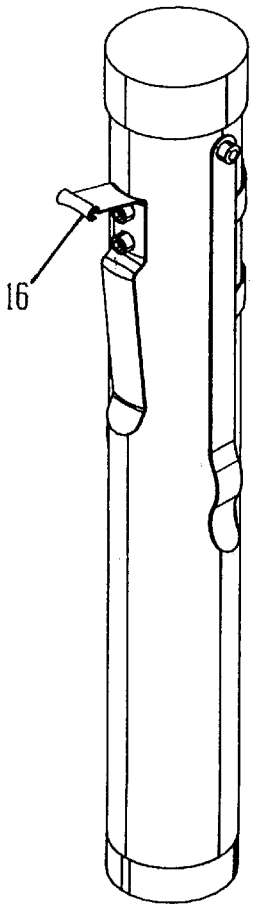
Figure 1C:
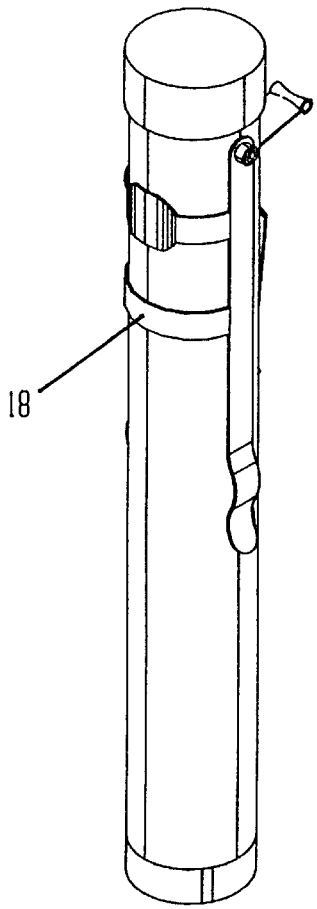
Figure 2:
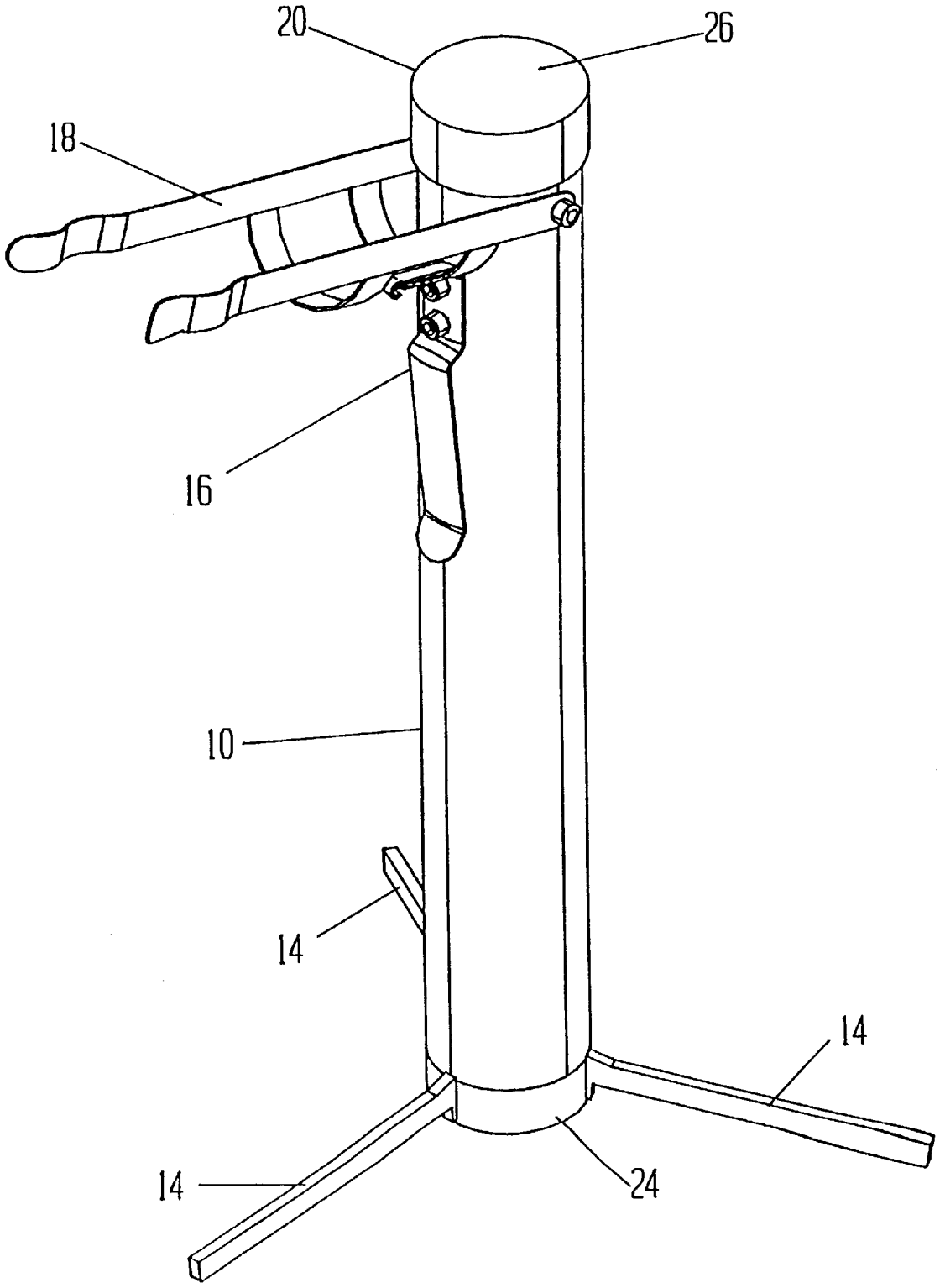
FIG. 2 shows the cigar support clip in extended position and the support legs in extended position thus making a stand of the instrument.

A typical embodiment of the instrument of the present invention is illustrated in FIGS. 1A, 1B, 1C, 2. The instrument has a tube body 10 with a match stop 12 to hold wooden matches inside a match holding compartment 28. A knurled cap 20 with a bulls-eye cutter 22 is threaded into the tube body with the knurled cap having a match striking surface 26. The tube body has a pocket clip with locking spring for cigar support 16 and a cigar support clip 18. A base mount 24 with support legs 14 makes a stand of the instrument.

OPERATION

FIGS. 1A, 1B, 1C, 2

The manner of using the combination cigar punch, stand and holder instrument is entirely by hand. While holding the tube body 10, unscrew the knurled cap 20 thereby allowing use of the bulls-eye cutter 22 to plug cigars for smoking. With knurled cap removed, rotate the cigar support clip 18 until it snaps into position with the pocket clip with locking spring for cigar support 16. Replace knurled cap. Turn base mount 24 counterclockwise to release base mount from the tube body. Place support legs 14 into extended position and replace base mount back into the tube body and turn clockwise to lock base mount into position with support legs extended. The knurled cap can then be used to strike a wooden match upon the match striking surface 26. A cigar then being gently placed into the cigar support clip readies the instrument for use as a cigar holder and stand combination. The tube body holds wooden matches in the match holding compartment 28.

SUMMARY, RAMIFICATION, AND SCOPE

This invention shows the reader that it eliminates the need for having to use a cigar ashtray by allowing one to use all types of table ashtrays. This instrument is easy to carry, easy to operate, and allows a cigar smoker to place their cigar safely down onto flat surfaces. It frees the cigar smoker's hands from continually holding the cigar in their hand or in their mouth. It makes doing other activities possible, and safer, by acting as a holding stand for their cigar. The instrument is obvious to the cigar smoker's need for them to safely free their hands from the cigar as cigarette smokers are able to do by using a variety of ashtrays that cigar smokers are unable to use.

The background search for prior arts indicate the absence of a cigar holding instrument for cigar smokers. There is a definite need of such an invention for cigar smokers, particularly an invention that both holds a cigar and then enables the cigar smoker to safely place the holder, with cigar, down repeatedly on a flat surface time and again as needed.

A disadvantage of this instrument rests with the knowledge that one has to smoke cigars and be a smoker in order to find use for the invention. Consequently, when one is a cigar smoker, the invention is a needed and useful one.

Accordingly, the reader will see that the invention is a practical and useful one for both holding and safely setting down cigars. The invention eliminates dangerous attempts of balancing a cigar onto an ashtray not intended for cigar use, or from attempting to lay a cigar down onto the edge of a table or similar structure where the cigar may roll off, thus preventing potential fire hazards.

The instrument also allows one to carry wooden matches in a safe dry compartment and provides a match striking surface for use in lighting cigars. One can plug, light, hold, and set down a cigar safely by use of this instrument.

Although the above descriptions contain certain specifications, these should not be construed as limiting the scope of the invention but as merely providing illustrations of some of the more readily noticed concepts of this invention. Thus the scope of the invention should not be determined by the claims and their equivalents, rather than by the examples given.

I claim:

1. A device for use with cigars, cigarettes and other smoking materials, said device comprising:

a tubular body with an open top end and an open bottom end, a match stop located within said tubular body forming a top compartment for storing wooden matches and a bottom compartment, a knurling cap having a top surface and bottom surface, wherein the top surface is a match striking surface and the bottom surface has a circular bulls-eye cutter attached thereto, said cap is removable attachable to the open top end of said tubular body to seal the top compartment, a base mount removably attachable to the open bottom surface of said tubular body, said base mount has three grooves spaced about the circumference to which three support legs are movably attached to allow the support legs to be rotated from a stored position inside of the bottom compartment to an extended position extending outwardly from the base mount forming a support stand for the device, a support clip pivotally attached to the top compartment of the tubular body to extend from a stored position against the tubular body to an extended position away from the tubular body, said clip having a pair of parallel appendages connected to each other by a plurality of cross sectional members, said members are curved for receiving the curved form of a cigar or cylindrical smoking material in said extended position and are also curved to fit tightly against said tubular body when the support clip is in said stored position, said appendages each having a semicircular curve located at the distal end and facing the tubular body in said stored position, a pocket clip with a locking spring attached to the top compartment on the side opposite to the support clip in the stored position, said pocket clip having a mid section attached directly to the tubular body with a lower section extending downwardly to said base mount, said lower section of the pocket clip biased against the body for holding the device in a pocket, an upper section forming said locking spring to hold the support clip in an extended position by engaging against a cross member.

* * * * *